United States Patent [19]

Mitchell

[11] Patent Number: 4,779,503

[45] Date of Patent: Oct. 25, 1988

[54] PORTABLE SAW STAND

[76] Inventor: Donald H. Mitchell, S. Main St., Rte. 1, Box 895, Pittsfield, N.H. 03263

[21] Appl. No.: 132,357

[22] Filed: Dec. 14, 1987

[51] Int. Cl.[4] ..... B27B 17/08

[52] U.S. Cl. ..... 83/796; 83/574; 83/381; 83/464; 83/788

[58] Field of Search ..... 83/796, 797, 452, 453, 83/574, 375, 380, 381, 788

[56] References Cited

U.S. PATENT DOCUMENTS

| | | | |
|---|---|---|---|
| 2,549,236 | 4/1951 | Rathert et al. | 83/796 |
| 4,009,631 | 3/1977 | Ekholm | 83/375 |
| 4,208,937 | 6/1980 | Marshall | 83/574 |
| 4,210,049 | 7/1980 | Gauthier | 83/796 |
| 4,214,498 | 7/1980 | Zukes et al. | 83/796 |
| 4,215,612 | 8/1980 | Peel | 83/796 |
| 4,258,600 | 3/1981 | Jackson | 83/574 |
| 4,307,640 | 12/1981 | Michael | 83/574 |
| 4,350,067 | 12/1982 | Picard | 83/796 |
| 4,538,494 | 9/1985 | Wirfelt | 83/796 |
| 4,553,463 | 11/1985 | Engel | 83/769 |
| 4,573,385 | 3/1986 | Funkhouser | 83/788 |
| 4,606,252 | 8/1986 | Lahti | 83/574 |
| 4,611,521 | 9/1986 | McCardle | 83/796 |

*Primary Examiner*—Donald R. Schran

[57] ABSTRACT

A portable stand for cutting timber has a base, a vertical support structure mounted upon the base and defining with the base a first functional area for resting timber thereupon to be cut. On the opposite side of the vertical support structure there is defined with the base a second functional area for an operator to be located. A beam is mounted horizontally upon and parallel to the vertical support structure. A chainsaw mount is pivotally disposed upon the beam for removably receiving a chainsaw, the chainsaw mount adapted for movement along the axis of the beam. A clamp arm clamps onto timber disposed upon the first functional area for resting timber.

9 Claims, 3 Drawing Sheets

PORTABLE SAW STAND

BACKGROUND OF THE INVENTION

This invention relates to a portable stand for supporting and cutting timber.

The practice of cutting timber with a chainsaw can be dangerous and physically exhausting. Generally the chainsaw used to cut the timber is hand held in such a way that the blade of the chainsaw is forced through a piece of timber that is resting on the ground. Engagement of the saw blade with the ground or movement of precariously supported timber during cutting can result in dangerous kick back. Furthermore, the sharpness of the blade can deteriorate rapidly, e.g., unless the saw is held off the ground after each use until blade run on is complete.

SUMMARY OF THE INVENTION

According to the invention, a portable stand for cutting timber has a base, a vertical support structure mounted upon the base and defining with the base a first functional area for resting timber thereupon to be cut and on the opposite side of the vertical support structure further defining with the base a second functional area for an operator to be located, a beam mounted horizontally upon and parallel to the vertical support structure, chainsaw mounting means pivotally disposed upon the beam for removably receiving a chainsaw, the chainsaw mounting means adapted for movement generally along the axis of the beam, and a first clamp arm adapted for clamping motion onto timber disposed upon the first functional area for resting timber.

Preferred embodiments of the invention may further include a chainsaw mounted with its blade extending over the first functional region for resting timber thereupon whereby pivoting the means for removably mounting a chainsaw causes the chainsaw blade to move in a vertical arc through the first functional region for cutting timber resting thereupon. The clamp arm is adapted for foot actuation. The chainsaw mounting means comprises a pivotable platform sized and adapted for receiving the chainsaw thereupon, and means for releasably attaching the chainsaw to the platform. The means for releasing the attaching chainsaw comprises a strap wrapped around the body of the chainsaw and a metal strip securing the chainsaw handle. A vertical stop member is adapted to limit the extent of the vertical arc of pivoting of the chainsaw mounting means. The portable stand is collapsible. The first functional region includes supports for resting timber thereupon, which are relatively close to the ground. The preferred embodiment may further include a second clamp arm synchronized with the first clamp and a horizontal stop member for preventing the pivoted chainsaw from contacting the clamp arms.

Other features and advantages of the invention will be apparent from the following description of a presently preferred embodiment and from the claims.

DESCRIPTION OF THE PREFERRED EMBODIMENTS

We first briefly describe the drawings.

STRUCTURE

Figure 2:
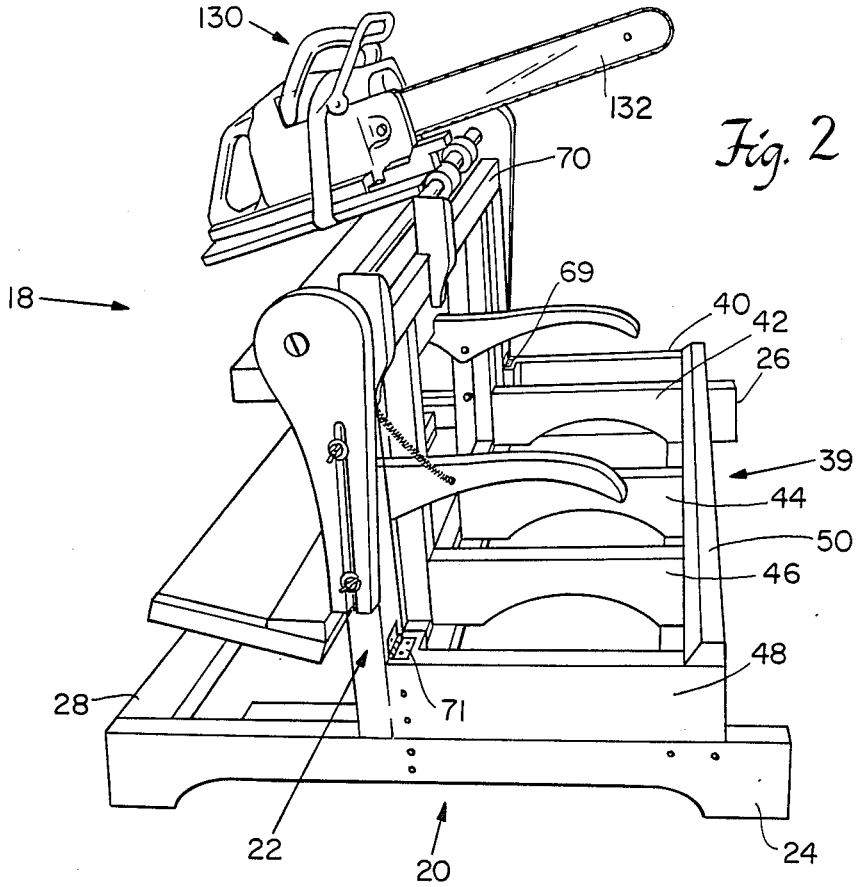
FIG. 2 is a side view of the portable saw stand of FIG. 1.
Figure 1:
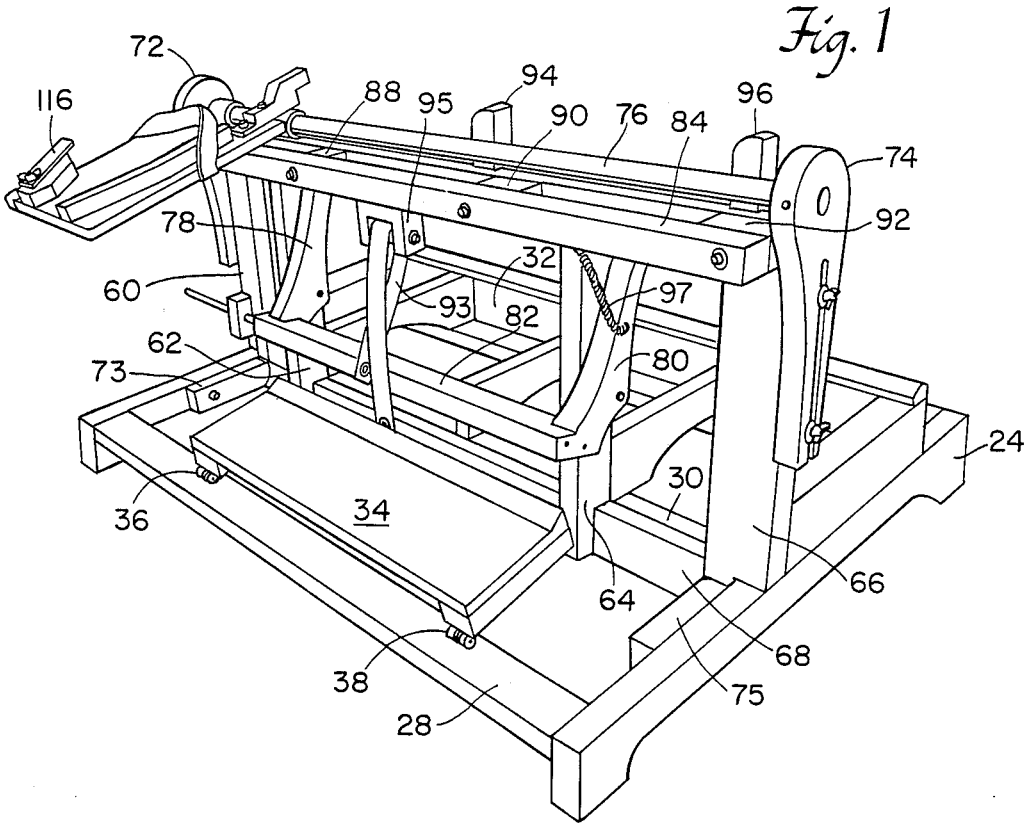
FIG. 1 is a perspective view of a portable saw stand in accordance with the present invention.
Figure 4:
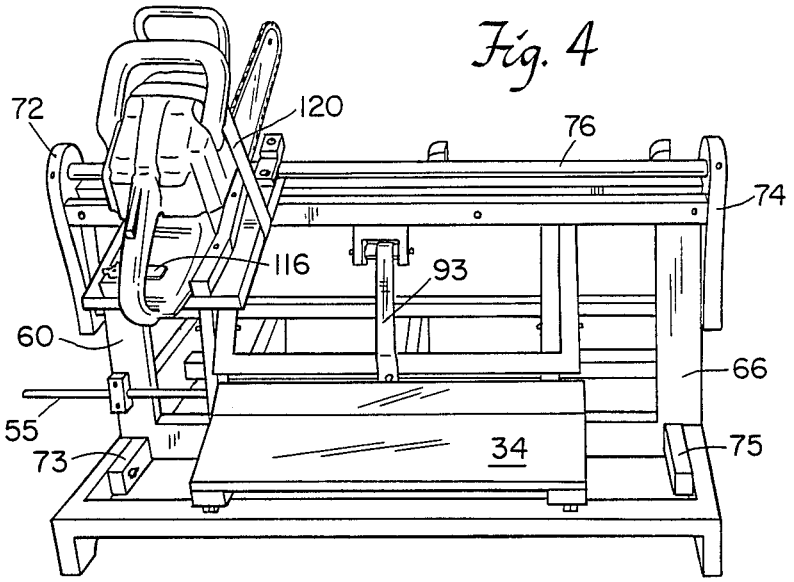
FIG. 4 is a rear (operator side) view of the portable saw stand of FIG. 1.
Figure 3:
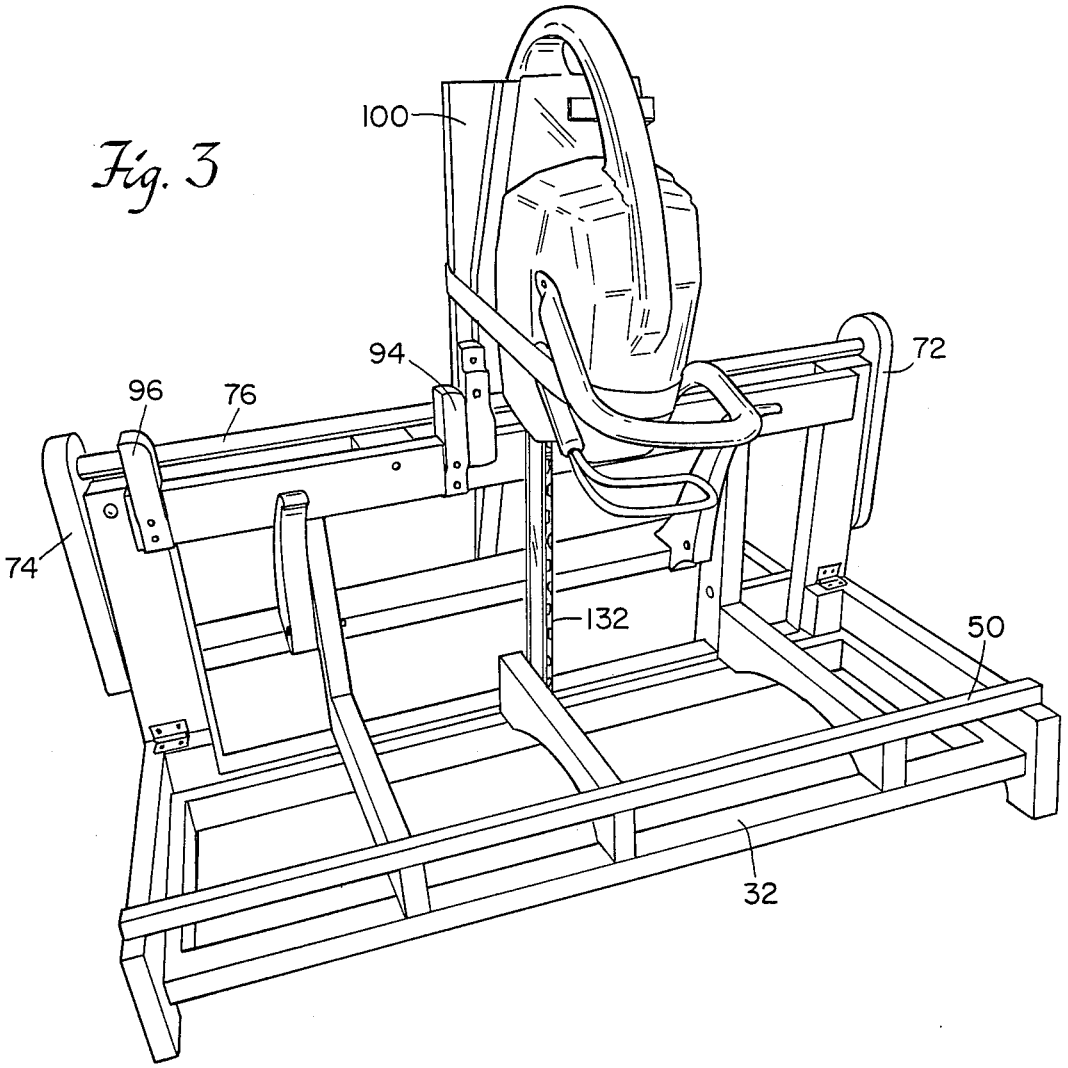
FIG. 3 is a front (timber side) view of the portable saw stand of FIG. 1.
Figure 5:
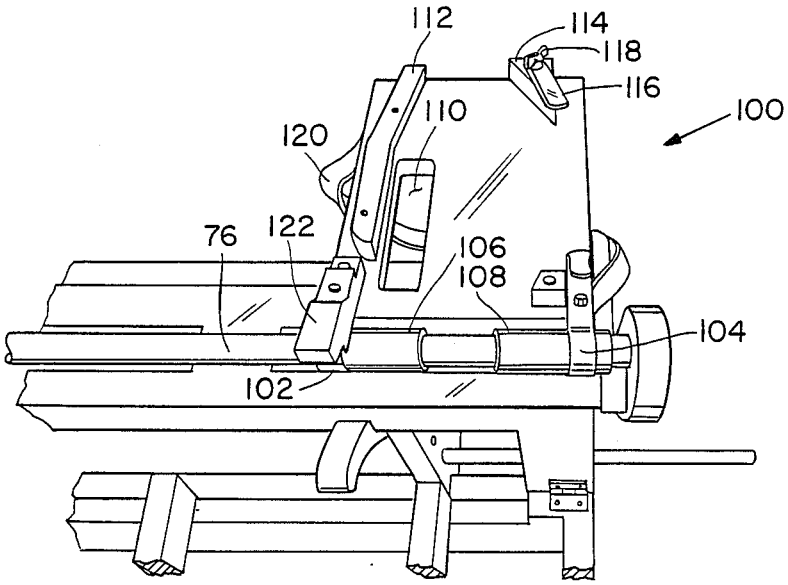
FIG. 5 is a plan view of the chainsaw platform of the portable saw stand of FIG. 1.

Referring to the figures, the present invention is a portable saw support stand 18 having a base 20, and having a vertical support structure 22 centrally and perpendicularly positioned on the base.

The base has leg members 24, 26 and cross members 28, 30, 32. Foot pedal 34 is attached to cross member 28 by hinges 36 and 38. Timber resting region 39 is defined by timber resting members 40, 42, 44, 46, and 48 which are located above and perpendicular to cross members 30 and 32, timber positioning member 50 which spans timber resting members 40–46 and is substantially parallel to cross member 32 and vertical support structure 22. The plane defined by timber resting members 40–46 and timber positioning member 50 is relatively close to the ground so that large pieces of timber can easily be placed upon it.

Vertical support structure 22 is constructed of legs 60, 62, 64, and 66 and cross members 68 and 70. Slotted holders 72 and 74 are movably attached to legs 60 and 66 respectively. Beam 76 is attached to movable holders 72 and 74 and runs generally parallel to cross member 70. Pulley support member 84 is attached to cross member 70 via blocks 86, 88, 90, and 92. Measuring dowel 55 is movably attached to leg 60.

When vertical support structure 22 is in an upright position, vertical support structure legs 60 and 66, which are notched, rest upon base leg members 24 and 26. Legs 60 and 66 are connected to timber resting members 40 and 48 by hinges 69 and 71. Legs 60 and 68 are held in an upright position by pivoting blocks 73 and 75. Pivoting blocks 73 and 75 also hold cross member 68 contiguous to base cross member 30. Legs 62 and 64 are contiguous with and perpendicular to timber resting members 42 and 46.

Clamping arms 78 and 80 are pivotally attached to legs 62 and 64. Clamping beam 82 connects and secures clamping arms 78 and 80. Strap 93 is attached to the center of clamping beam 82, fed through pulley 95 and attached to the edge of foot pedal 34 opposite the edge to which hinges 36 and 38 are attached. Spring 97 is connected between pulley support member 84 and clamping arm 80. Movable stop blocks 94 and 96 are also attached to cross member 70.

Chainsaw platform 100 is pivotally attached to beam 76 by steel straps 102 and 104 wrapped about plastic sleeve bearings 106 and 108. Platform 100 defines hole 110, through which sawdust can pass, and positioning pieces 112 and 114. Strip 116 is movably attached to positioning piece 114 by wingnut 118. Strap 120 is also attached to platform 100.

Block 122 is attached to platform 100 such that it extends over beam 76 when platform is in a substantially horizontal position.

Chainsaw 130 is positioned between positioning pieces 112 and 114 and held in place by strap 120, which is wrapped around the body of chainsaw 130 and strip 116, which secures the handle of chainsaw 130. Blade 132 extends over timber resting region 39.

OPERATION

Timber (not shown) is placed upon timber resting members 40–48 using measuring dowel 55 to accurately position the timber. Foot pedal 34 is depressed to cause strap 93 to actuate clamping beam 82 to cause clamping arms 78 and 80 to pivot, thereby securing the timber to timber resting members 40–48.

Platform 110 is slid along beam 76 until block 102 contacts block 94; in this way, the timber will be accurately cut. Chainsaw 130 is then moved in a vertical arc to cut timber. (Block 102 will stop blade 132 when the blade is substantially vertical.) Platform 110 is then slid to block 96 to make the next cut. After the timber is cut, foot pedal 34 is released to allow spring 97 to retract, pivoting clamping arms 78 and 80 away from the timber.

Figure 6:
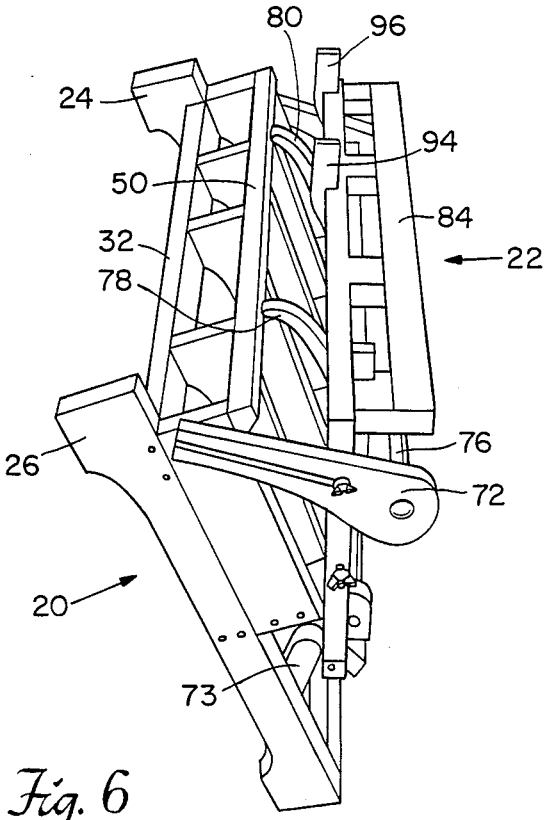
FIG. 6 is a perspective view of the portable stand of the invention in collapsed condition.

The portable stand of the present invention is collapsible (FIG. 6) so that vertical support structure 22 rests against base 20 thereby allowing the saw support to be easily transported. Saw support 18 is collapsed by pivoting blocks 73 and 75 so that vertical support structure 22 moves about hinges 69 and 71. Movable holders 72 and 74 are also rotated so that beam 76 and platform 100 are move below pulley support member 84.

Other embodiments are within the following claims.

What I claim is:

1. A portable stand for cutting timber comprises:

a horizontal base, a vertical support-structure mounted upon said base, and extends upwardly therefrom partially defining with said base a first functional region for resting timber therein to be cut and on the opposite side of said vertical support structure further partially defining with said base a second functional region for an operator to be located, a beam mounted horizontally upon and parallel to said vertical support structure at a position spaced from the, base chainsaw mounting means for removably receiving a chain saw pivotally disposed upon said beam for pivoting the chainsaw in a vertical arc, said chainsaw mounting means also movable generally along the axis of said beam, and a first clamp arm extending over said first functional area, means for moving said clamp arm for clamping onto timber disposed upon said first functional region for resting timber.

2. The portable stand of claim 1 wherein a chainsaw is mounted with its blade extending over said first functional region for resting timber therein whereby pivoting the means for removably mounting a chainsaw causes the chainsaw blade to move in a vertical arc through said first functional region for cutting timber resting therein.

3. The portable stand of claim 1 wherein the means for moving said clamp arm includes for means permitting foot actuation.

4. The portable stand of claim 1 wherein said chainsaw mounting means comprises a pivotal platform sized and means for receiving said chainsaw thereupon, and means for releasably attaching said chainsaw to said platform.

5. The platform of claim 4 wherein said means for releasably attaching said chainsaw comprises a strap wrapped around a body of the chainsaw and a strip for securing a handle of the chainsaw.

6. The portable stand of claim 1 further comprising a vertical stop member adapted to limit the extent of the vertical arc of pivoting of said chainsaw mounting means.

7. The portable stand of claim 1 wherein said stand is collapsible.

8. The portable stand of claim 1 wherein there are supports which provide support for resting timber which are relatively close to the ground within said first functional region.

9. The portable stand of claim 1 further comprising, a second clamp arm connected for synchronized motion with said first clamp arm, and at least one horizontal stop member adapted to position said chainsaw mounting means such that a chainsaw attached to said chainsaw mounting means will not contact said first and second clamp arms when said chainsaw mounting means is pivoted.

* * * * *

UNITED STATES PATENT AND TRADEMARK OFFICE

CERTIFICATE OF CORRECTION

PATENT NO. : 4,779,503

DATED : October 25, 1988

INVENTOR(S) : Donald H. Mitchell

It is certified that error appears in the above-identified patent and that said Letters Patent is hereby corrected as shown below:

Claim 1, col. 3, line 32, after "therefrom" insert --and--; line 41, after "the" change ", base" to --base,--; and col. 4, line 6 change "resting" to --arresting--.

Claim 3, col. 4, line 15 change "for means" to --means for--.

Signed and Sealed this

Sixth Day of June, 1989

*Attest:*

DONALD J. QUIGG

*Attesting Officer*

*Commissioner of Patents and Trademarks*